US012129577B2

(12) United States Patent
Ozden et al.

(10) Patent No.: US 12,129,577 B2
(45) Date of Patent: Oct. 29, 2024

(54) COMPOSITE YARN COMPRISING AT LEAST TWO BUNDLES OF COALESCED ELASTIC FILAMENTS AND A PLURALITY OF INELASTIC ELEMENTS

(71) Applicant: Sanko Tekstil Isletmeleri San. Ve Tic. A.S., Inegol-Bursa (AR)

(72) Inventors: Erdogan Baris Ozden, Inegol-Bursa (AR); Fatma Korkmaz, Inegol-Bursa (AR); Tuncay Kilickan, Inegol-Bursa (AR)

(73) Assignee: SNAKO TEKSTIL ISLETMELERI SAN. VE TIC A.S., Inegol-Buris (AR)

( * ) Notice: Subject to any disclaimer, the term of this patent is extended or adjusted under 35 U.S.C. 154(b) by 307 days.

(21) Appl. No.: 17/603,674

(22) PCT Filed: Apr. 17, 2020

(86) PCT No.: PCT/EP2020/060937
§ 371 (c)(1),
(2) Date: Oct. 14, 2021

(87) PCT Pub. No.: WO2020/212618
PCT Pub. Date: Oct. 22, 2020

(65) Prior Publication Data

US 2022/0298678 A1 Sep. 22, 2022

(30) Foreign Application Priority Data

Apr. 17, 2019 (EP) ..... 19169982

(51) Int. Cl.
*D02G 3/32* (2006.01)

(52) U.S. Cl.
CPC ..... *D02G 3/32* (2013.01); *D10B 2331/02* (2013.01); *D10B 2331/04* (2013.01)

(58) Field of Classification Search
CPC .. D02G 3/32; D10B 2331/02; D10B 2331/04; D10B 2501/00; D03D 15/56
USPC ..... 442/301, 184; 428/299.7, 300.4, 296.7, 428/401, 364
See application file for complete search history.

(56) References Cited

U.S. PATENT DOCUMENTS

| | | | |
|---|---|---|---|
| 3,094,374 | A | 6/1963 | Smith |
| 3,940,917 | A | 3/1976 | Strachan |

FOREIGN PATENT DOCUMENTS

| | | |
|---|---|---|
| JP | S6420351 | 1/1989 |
| JP | 2000282346 | 10/2000 |
| JP | 2006225798 | 8/2006 |
| WO | 2008130563 | 10/2008 |
| WO | 2016105539 | 6/2016 |

OTHER PUBLICATIONS

International Search Report issued by the EPO on May 25, 2020 for International application No. PCT/EP2020/060937.

*Primary Examiner* — Camie S Thompson

(57) ABSTRACT

The present invention relates to a composite yarn (100) comprising at least two bundles of elastic filaments (101, 102) and a plurality of inelastic elements (103), wherein said bundles of elastic filaments (101, 102) comprise a plurality of elastic filaments (150) connected one to the other in a substantially continuous manner, each of said inelastic element (103) is chosen among an inelastic filament or a bundle of coupled inelastic filaments, said bundles of elastic filaments (101, 102) and said inelastic elements (103) are connected to each other by intermingling.

21 Claims, 5 Drawing Sheets

COMPOSITE YARN COMPRISING AT LEAST TWO BUNDLES OF COALESCED ELASTIC FILAMENTS AND A PLURALITY OF INELASTIC ELEMENTS

This application is a U.S. national stage of PCT/EP2020/060937 filed on 17 Apr. 2020 which claims priority to and the benefit of European Application No. 19169982.6 filed on 17 Apr. 2019, the contents of which are incorporated herein by reference in their entireties.

FIELD OF THE INVENTION

The present invention relates to elastic yarns, and in particular to composite elastic yarns. The yarns of the invention find application in particular in the production of fabrics for high elasticity garments, e.g. jeggings and similar garments.

BACKGROUND OF THE INVENTION

Elastane or Spandex filaments and yarns are known in the art and have been widely used in the textile field for producing elastic yarns and fabrics. Filaments of elastane are produced by extrusion of a polyurethane polymer through a spinneret having several extrusion cells. Before the filaments exit the extrusion machine, an amount of solid single filaments, or strands, are coalesced together to produce a bundle of filaments having the desired count, i.e. the desired thickness. Thus, each bundle of filaments of elastane (spandex) is made up of many smaller individual filaments coalesced together, i.e. that adhere to one another because of the natural stickiness of their surface at the moment they come into contact with each other during the production process. A suitable production process of coalesced multifilament bundles is disclosed in U.S. Pat. No. 3,094,374.

The bundle of elastane filaments are used to prepare yarns. It is known to produce elastic yarns by combining a single bundle of coalesced elastane filaments with a plurality of substantially inelastic (or substantially non-stretchable) polyester filaments.

These types of elastic yarns may have provide some problems when used for producing high elasticity fabrics. The main issue with this kind of fabrics is known as "elastane breakage" or "elastane slippage", i.e. the elastic yarns may break and retract. This results in a sliding into the fabric of the broken elastic yarn from the location of the breakage, especially on the sewing edge area mainly on both hips side and crotch of the garment.

These problems may arise e.g. while sewing with overlock seam or folded seam, or when performing a dry scraping process, or during washing in industrial laundry machines, or during drying in tumble dryer, during home washing, etc.

WO2008130563 discloses a composite yarns have a filamentary core provided with at least one elastic performance filament and at least one inelastic control filament. A fibrous sheath, preferably formed from spun staple fibers, surrounds the filamentary core, preferably substantially along the entire length thereof. The at least one elastic performance filament most preferably includes a spandex and/or a lastol filament.

SUMMARY OF THE INVENTION

It is an aim of the present invention to solve the above mentioned problems and provide yarns that, when used in high elasticity garments, are not (or at least less) affected by breakage and "slippage" of the elastic yarns.

This and other objects are reached by the present solution according to one or more of the enclosed claims.

An aspect of the invention relates to a composite yarn, a fabric, an article and a process according to the independent claims, while preferred aspects are recited in the dependent claims.

According to an aspect, a composite yarn comprises at least two bundles of elastic filaments and a plurality of inelastic elements. Among the bundles of elastic filaments coalesced together (from now on referred to also as "elastic bundles") there is at least a first bundle of elastic filaments (from now on referred to also as "first elastic bundle") and a second bundle of elastic filaments (from now on referred to also as "second elastic bundle"), and each of the first and second bundle comprises a plurality of elastic filaments connected, i.e. coalesced, one to the other in a substantially continuous manner. The inelastic elements may be different, i.e. a plurality of inelastic filaments, or different, i.e. a plurality of bundles of inelastic filaments. Preferably a plurality of bundles of coalesced elastic filaments is combined with a plurality of individual inelastic monofilaments. The first bundles of elastic filaments and the inelastic filaments are connected via intermingling. The intermingling connections provide knots.

Intermingling is thus used to couple the bundles of elastic filaments and the inelastic elements that, before intermingling, were typically substantially separate elements.

As mentioned, each bundle of filaments comprises a plurality (at least two) of elastic filaments that are coalesced, i.e. connected, one to the other (e.g. in the production step or via bonding, gluing, or similar) in a substantially continuous manner. "Substantially continuous" means that the connection between the filaments is not punctual (as e.g. provided by intermingling) but there are continuous portions of the filaments that are connected one to the other. It is in fact known that, for elastic textile elements, an amount of filaments may be coalesced (bundled) together to produce the desired thickness. It is e.g. known that a yarn of spandex is typically provided as a bundle of coalesced filaments, as elastane yarns may be composed of a plurality of smaller individual filaments that adhere to one another to provide a multifilament bundle i.e. a bundle of coalesced filaments.

The bundle is elastic; it can be stretched (as elongation at break) by a value that is in the range between 50% and 1000% according to DIN 53820 part 2.

The inelastic element is "inelastic" as it has an elongation at break less than the elastic bundle when measured when the same test, preferably less than 75%, more preferably less than 50% than the elastic bundle. Typically, the inelastic element is provided with an elongation at break that is between 5% and 100% according to DIN ISO 2062.

The filaments of the same elastic bundle are connected in a substantially continuous manner, as mentioned this is carried out in the production step.

As a result, in the claimed solution there are at least two, and preferably more than two, elastic filament bundles that do not behave and move (and thus possibly break) like a single element but, even if intermingled with the inelastic elements, retain a certain independency one from the other. The elastic multifilament bundles are separate from each other so that if one bundle is cut in a sewing step or breaks under stress, the remaining bundles of elastic filaments can still provide elasticity to the yarn. This fact provides a better resistance to stresses, and in particular it may limit damage only to part of the elastic bundles (or filaments of the bundles) in the above mentioned situations.

Preferably, the composite yarn essentially consists in the above mentioned elastic bundles and inelastic elements. In particular, according to a preferred aspect, the yarn as above discussed is not used as a core of a core-sheath composite yarn. In other words it is not covered by means of a sheath of staple fibers.

According to an aspect, the composite yarn consists of elastic bundles and inelastic filaments.

As mentioned, in preferred embodiments, there are more than two elastic bundles.

Embodiments of the present invention may in fact provided with at least three elastic bundles, or at least five elastic bundles, or at least seven elastic bundles. Exemplary and preferred embodiments are provided with 2, preferably 3, to 22 elastic bundles.

In an embodiment, the composite yarn comprises, in addition to the above mentioned bundles of elastic filaments, at least one, preferably a plurality of single elastic filaments. Single elastic filaments may be obtained by avoiding to coalesce the single filaments into bundles at their production stage.

As a general concept, the number and count of inelastic elements is not limited.

Preferably, however, the total count of inelastic elements is equal or preferably greater than the total count of the elastic elements. In other words, preferably, the percentage in weight of the inelastic elements in the composite yarns is greater than the percentage in weight of the elastic elements in the composite yarn. In the final yarn, the elastic filaments may be between 5% and 50% by weight of the final composite yarn.

Also, according to an aspect, the number of inelastic elements in the composite yarn is greater than the number of the elastic bundles in the final yarn.

According to an aspect, each of the inelastic elements comprise at least one polyester filament and/or a polyamide filament, and/or a polyester copolymer, and/or a polyamide copolymer.

An object of the invention is a composite yarn according to claim 1. Objects of the present invention relate also to a fabric, preferably a woven fabric, according to claim 13 and comprising a yarn according to one or more of the above aspects, and to an article, preferably a garment, comprising such a fabric, according to claim 15.

In addition, the present invention relates to a process according to claim 11. Said process for producing a composite yarn comprises the steps of: providing a plurality of inelastic elements, each elastic element being selected between a filament or a bundle of coupled filaments; providing at least two bundles of elastic filaments comprising a plurality of elastic filaments connected to each other in a substantially continuous manner, the bundles of elastic filaments being separate from each other; intermingling the bundles of elastic filaments and the inelastic elements; collecting the composite yarn obtained via the intermingling step. Preferably, intermingling is carried out via air-jet intermingling.

By using a plurality of bundles of coalesced elastic filaments and a plurality of inelastic filaments and by intermingling them into entanglement points, or knots, it is possible to obtain a final yarn that has no or very reduced elastane slippage; the elastic the yarn may actually be also be used as such, without further treatments.

Exemplary and non-limiting embodiments are now discussed with reference to the following figures, wherein.

DETAILED DESCRIPTION OF EXEMPLARY EMBODIMENTS

Figure 1:
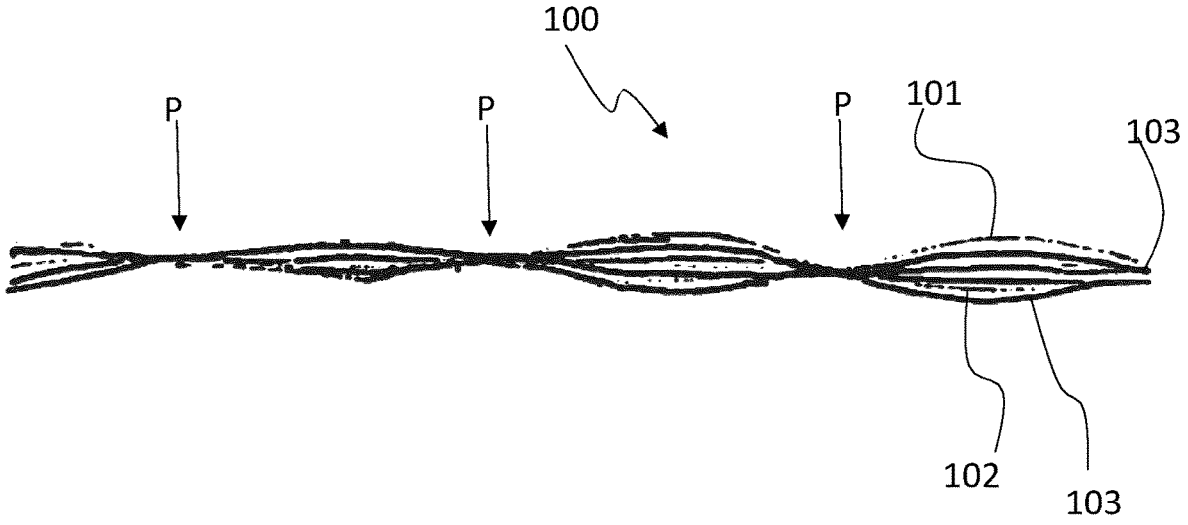
FIG. 1 is a schematic view of a portion of a composite yarn according to an embodiment of the invention.

A composite yarn 100 comprises at least two bundles of elastic filaments (referred also, as before mentions, as "elastic bundles") 101, 102, among which there are at least one first elastic bundle 101 and a second elastic bundle 102.

For easiness of visualization and description, reference is made to two bundles of coalesced elastic filaments 101, 102. Different embodiments may be provided with a greater number of elastic bundles 101, 102; according to embodiments 3 to 8 bundles of coalesced elastic filaments are provided.

A possible embodiment of an elastic bundle is provided with two elastic filaments, e.g. 40D/40D elastic filaments (elastane). In a further possible embodiment, an elastic bundle 101, 102 is provided with four elastic filaments, e.g. 20D/20D/20D/20D elastic filaments (elastane). A further possible embodiment of an elastic bundle is provided with seven elastic filaments, e.g. 10D/10D/10D/10D/10D/10D/10D elastic filaments (elastane), where "D" stands for denier.

The bundle of filaments 101, 102 have preferably a count comprised between 20 and 1000 denier, preferably between 50 and 300 denier. The number of filaments coalesced together is 2 to 200, preferably 4 to 150, more preferably 6 to 100.

The elastic filaments 150 are preferably elastomeric filaments, i.e. filaments that can be stretched repeatedly at room temperature to at least twice their original length and which after removal of the tensile force will immediately and forcibly return to approximately their original length. According to an aspect, the elastic filaments 150 are polyurethane filaments, such as elastane filaments.

The elastic bundles 101, 102 comprise a plurality of elastic filaments 150. The elastic filaments 150 are connected one to the other in a substantially continuous manner.

Elastic filaments 150 can be connected in a substantially continuous manner to each other by any known means.

The composite yarn 100 comprises a plurality of inelastic element 103. In the shown embodiment, the inelastic elements 103 are part of a bundle of inelastic filaments. As a result, in the shown embodiment, an inelastic element 103 corresponds to an inelastic filament. Different embodiments may provide that an inelastic element is a plurality of connected (e.g. bonded) inelastic subfilaments. The count of an inelastic filament is lower than the count of the elastic filament 101. Preferred inelastic filaments have a count comprised between 0.5 and 3 den.

The composite yarn 100 comprises a plurality of inelastic elements 103, where the inelastic element can be a single inelastic filament or a bundle of inelastic subfilaments.

Each source of bundle of filaments may have different counts/denier of bundle of filaments and at final product there may be combination of different counts/denier of total bundle of filaments such as 40 Denier+30 Denier The inelastic elements 103 are preferably monofilaments, i.e. single filaments of partially oriented yarn (POY), known in the art. Preferable filaments for the inelastic elements 103 are selected from polyester filaments and polyamide (nylon) filaments, or filaments made in polyester or polyamide copolymers. The inelastic filaments are preferably textured filaments.

Each elastic bundle may be drawn with different level of draft ratios.

The inelastic elements 103 may also comprise filaments that are bi-component filaments, such as PBT/PTT or PET/PTT or PET/PTMT bi-component filaments.

The elastic bundles 101, 102 and the inelastic elements 103 are connected to each other at a plurality of points P, via intermingling, to provide the final composite yarn 100. As a result, in the final composite yarn 100, there is a portion of the first elastic bundle 101 that is not connected to the second elastic element 102 (i.e. between two subsequent connection points P), and that can behave in substantially independent manner with respect to the corresponding portion of the second elastic bundle 102. As above mentioned, to help providing such an independency, it is preferred that, as shown in the figures, the elastic bundles 101 102 are fed as independent bundles, e.g. at least in a non-twisted state, to the intermingling device.

Intermingling is preferably provided via air jet intermingling.

Figure 2:
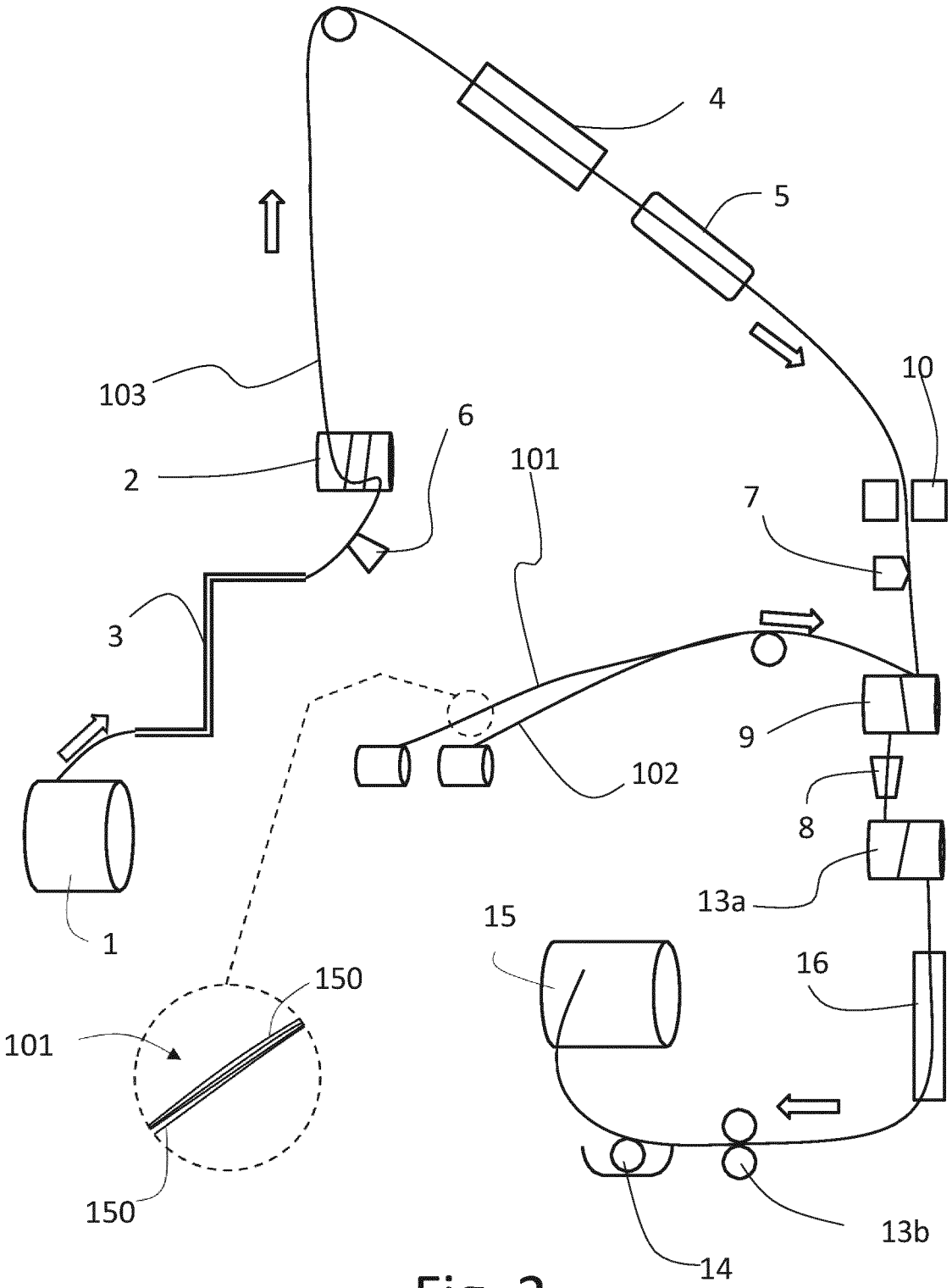
FIG. 2 is a schematic view of a possible apparatus for producing a composite yarn as per FIG. 1.
Figure 3:
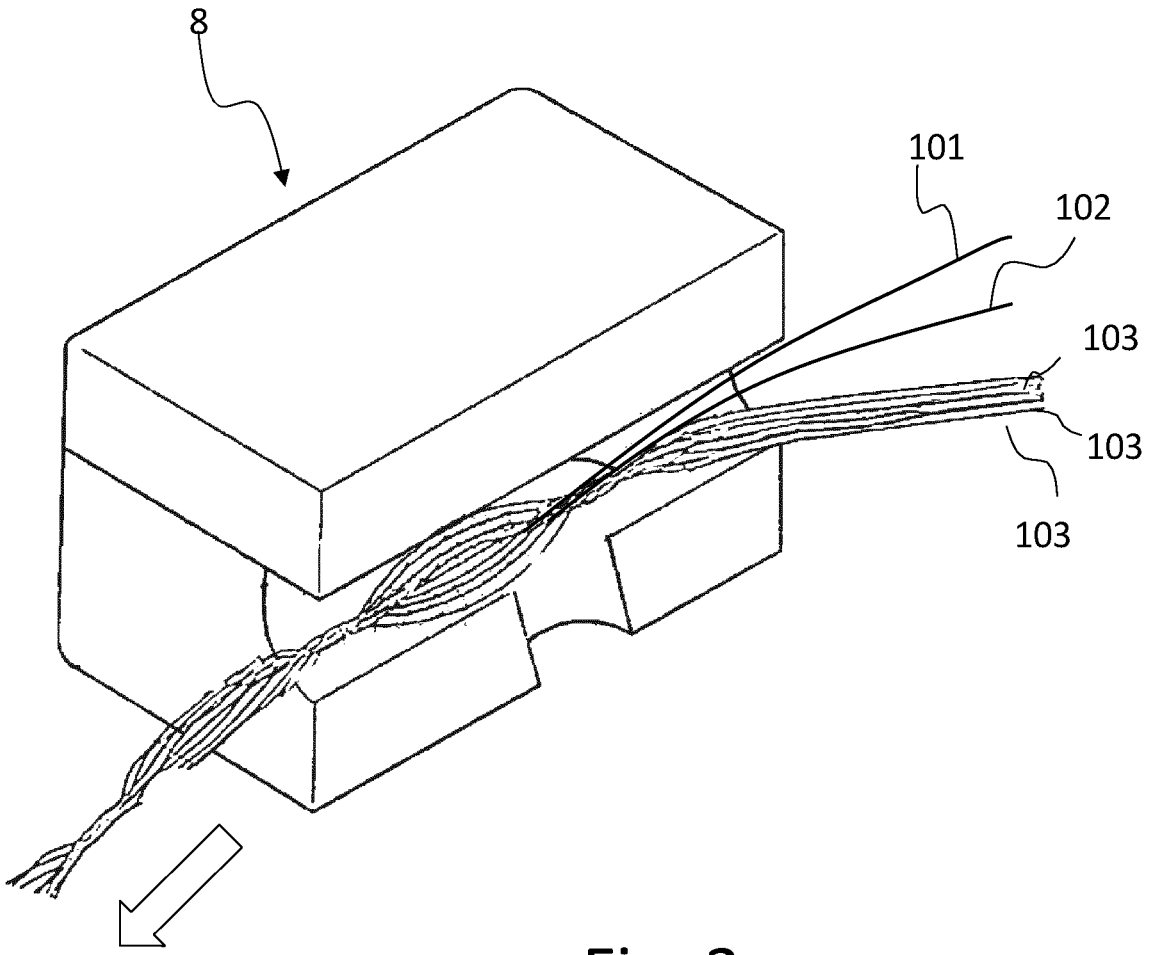
FIG. 3 is a schematic view of an intermingling device that may be used in an apparatus as per FIG. 2.
Figure 4:
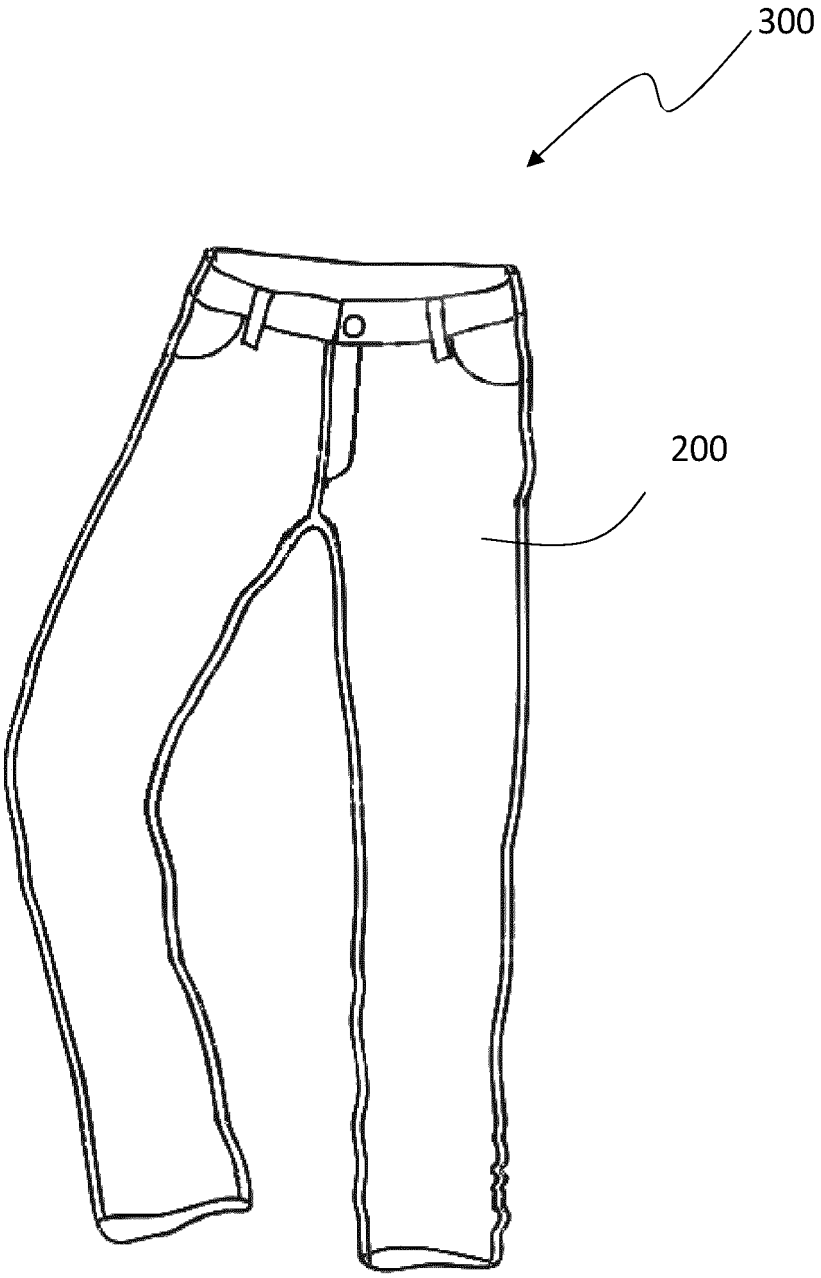
FIG. 4 is a schematic view of a garment obtained comprising a fabric comprising in turn a composite yarn as per FIG. 1
Figure 5:
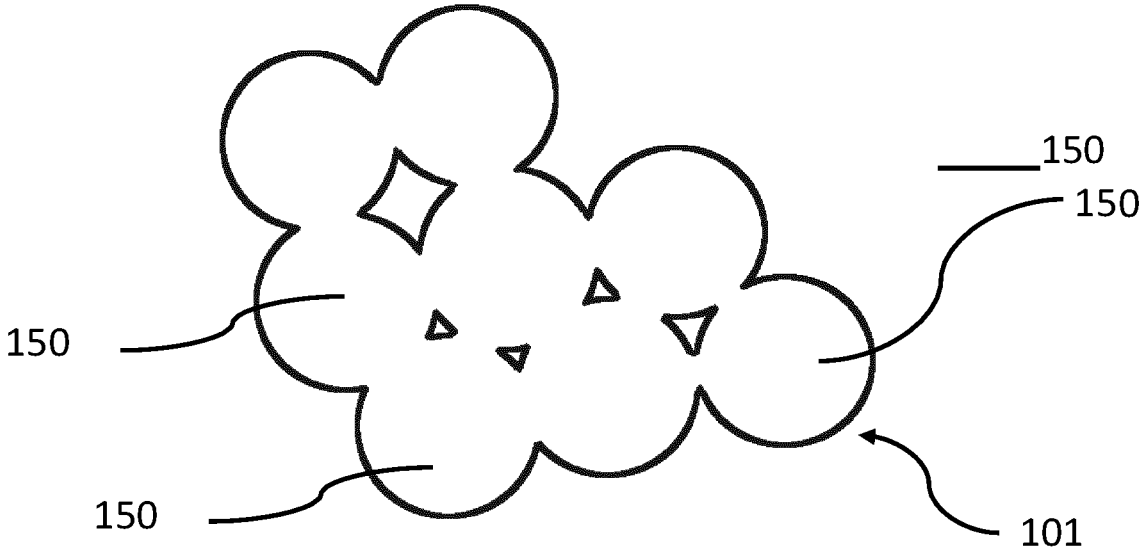
FIG. 5 is a schematic section view of three monofilaments.
Figure 6:
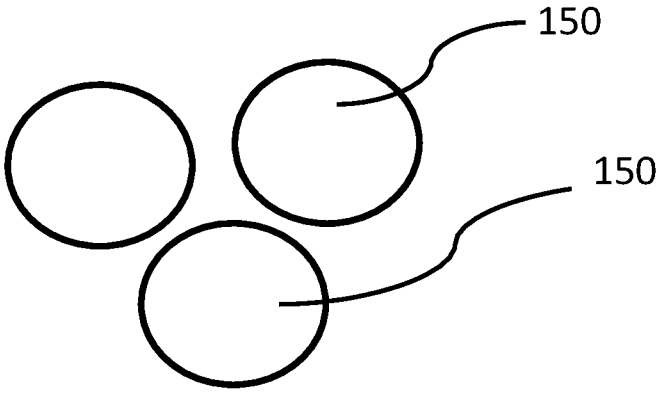
FIG. 6 is a schematic view of a bundle of coalesced elastic filaments.

The composite yarn 100 is typically used to provide a fabric 200, preferably a woven fabric. An aspect of the invention relates to an article 300, typically a garment, that comprises such a fabric 200. According to possible embodiments, as the one shown in FIG. 2, during the process for producing a composite yarn according to the present invention, the inelastic elements 103 are provided by one or more sources 1, e.g. one or more bobbins. In the shown embodiment, a single source 1 provides a bundle of separate inelastic elements (i.e. inelastic filaments) 103.

The inelastic elements 103 can be passed through a guide 3, e.g. a tube, and drafted via drafting means 2, e.g. one or more drafting rollers.

The inelastic elements 103 may be also heat treated, e.g. via a heating element 4, possibly followed by a cooling element 5, e.g. a heating chamber and a cooling chamber through which the inelastic elements 103 are passed. Temperature of the first heating element can be between 180 and 210° C.

Sensor 6 may be provided to verify whether a breakage of the inelastic elements occurs during the process, so as to monitor and avoid that they are no longer fed from source 1. Further sensors 7 may be provided to verify the tension of the inelastic elements 103.

Elastic bundles 101, 102 are withdrawn from relevant sources 11, 12. Preferably, each elastic bundle 101, 102 is withdrawn from a different source 11, 12. As a result, for at least a part of their path, the first elastic bundle 101, the second elastic bundle 102 and the inelastic elements 103 run along different and separate paths.

The inelastic elements 103 and the elastic bundles 101, 102 are then connected together at a plurality of connection points P via an intermingling device 8, preferably an air-jet intermingling device.

As mentioned, the intermingling device provides a plurality of connection points P between the filaments of the final yarn. In particular, as known, intermingling provides a plurality of connection points P (knots) between the filaments 101, 103 of the final yarn. There are known ways and testing machine to measure number of entanglement/knots per meter on a yarns.

As an example, in ITEMAT+ by Textechno H. Stein (Moenchengladbach, DE; https://www.textechno.com), in an "interlace test" a yarn is passed between two cylinders at a pre-determined elongation, to evaluate the number of the intermingling points. At each intermingling point there is provided an entanglement or knot of the elastic and inelastic filaments that remains also when the yarn is tensioned or stretched and that can be sensed by the testing machine in the otherwise smooth yarn.

Preferably, when tested with a similar machine, and when the stretched with an elongation at about 6.0%, a yarn according to the invention is provided with at least 50 connection points (i.e. knots) per meter, more preferably at least 80 connection points/knots per meter, even more preferably at least 100 connection points/knots per meter. A preferred number of knots is in the range of 80 to 120 knots/meter.

According to a preferred aspect, the inelastic elements 103 are overfed to the intermingling device 8, preferably at a percentage between 1.2% and 7.0%.

Before intermingling, the elastic bundles 101, 102 and the inelastic elements can be passed together in a drafting device 9, e.g. a drafting roller. Preferably, the drafting of drafting device 9 (applied to both elastic bundles 101, 102 and inelastic elements 103) is greater than the drafting applied to the inelastic elements 103 by drafting device 2 (placed upstream of the drafting device 9). In particular, the drafting applied to drafting device 9 can be between 1.5 and 1.8 greater than the drafting applied by drafting device 2.

Preferably, the draft of the elastic bundles 101 is between 1.1 and 6.9 more preferably 2 to 6, even more preferably 3 to 5. Regarding the inelastic elements 103, draft is preferably lower than 6, more preferably lower than 5, even more preferably lower than 4. In addition, the elastic filaments 101 are preferably drafted more than inelastic elements 103.

In addition, before being connected to the elastic bundles 101, 102, the inelastic elements 103 may be texturized, via a texturing device 10. Any suitable texturizing device, such as a friction discs device, may be used.

After intermingling, a composite yarn is formed, where elastic bundles 101, 102 and inelastic elements 103 are connected via intermingling.

Further finishing processes may be carried out, e.g. a heat treatment via a heating chamber 16 and/or a further drafting via one or more drafting device(s) 13*a*, 13*b*, and/or application of a finishing agent, e.g. an oil or a similar element, via a finishing device 14.

The composite yarn 100 is finally collected on a collecting element 15; typically it is wound on a bobbin.

In an embodiment, during the production process, substantially no further yarns, rovings or similar textile elements are added to the composite yarn 100, that can thus be used in such a form, i.e. essentially comprising the elastic bundles 101, 102 and the inelastic elements 103 as a yarn to manufacture a fabric, in particular a woven fabric 200, for an article 300, such as a garment.

The invention claimed is:

1. A composite yarn (100) comprising at least two bundles of elastic filaments (101, 102) and a plurality of inelastic elements (103), wherein:

said bundles of elastic filaments (101, 102) comprise a plurality of elastic filaments (150) connected together;

said inelastic elements (103) comprise a plurality of inelastic filaments and/or at least a bundle of inelastic filaments;

said bundles of elastic filaments (101, 102) and said inelastic elements (103) are connected to each other by intermingling, wherein each of the at least two bundles of elastic filaments (101, 102) has a different denier.

2. The composite (100) yarn according to claim 1, wherein each of said inelastic elements (103) comprise at least one polyester filament and/or a polyamide filament.

3. The composite yarn (100) according to claim 1, comprising a number of entanglement points at least as great as 100 entanglement points per meter when stretched with an elongation at about 6.0%.

4. The composite yarn (100) according to claim 1, wherein the elastic filaments (101) are drafted and wherein each of said bundle of elastic filaments includes 6 to 100 filaments.

5. The composite yarn (100) according to claim 4, wherein the draft of the inelastic elements (103) is less than the draft of the elastic filaments (101).

6. The composite yarn (100) according to claim 1, wherein the inelastic elements (103) are texturized.

7. The composite yarn (100) according to claim 1, wherein said inelastic elements (103) comprise bi-component filaments.

8. The composition yarn (100) according to claim 7, wherein said bicomponent filaments are selected from the group consisting of PET/PTT, PBT/PTT and PET/PTMT.

9. The composite yarn (100) according to claim 1, comprising at least three said bundles of elastic filaments (101, 102) and wherein a weight percentage of the inelastic elements is greater than a weight percentage of the elastic elements in the composite yarn.

10. The composite yarn according to claim 1, wherein the count of each of said bundles of elastic filaments (101, 102) comprises between 50 and 300 denier.

11. The composite yarn according to claim 1, further comprising at least one further single elastic filament intermingled with said inelastic elements (103).

12. A fabric (200) comprising a composite yarn according to claim 1.

13. An article (300) comprising a fabric (200) according to claim 12.

14. The composite yarn (100) according to claim 1, wherein the count of an inelastic filament of said plurality of inelastic filaments is lower than a count of one of said elastic filaments.

15. The composite yarn (100) according to claim 1, wherein the count of an inelastic filament of said plurality of inelastic filaments is lower than a count of one of said elastic filaments and the total count of said plurality of inelastic filaments is greater than a total count of said elastic filaments.

16. A process for producing a composite yarn (100) comprising the steps of:

a. withdrawing at least two bundles of elastic filaments (101, 102) from different sources, each bundle comprising a plurality of elastic filaments (150) connected together;

b. providing a plurality of inelastic elements (103), said inelastic elements (103) comprising a plurality of filaments and/or a bundle of coupled filaments;

c. providing said at least two bundles of elastic filaments (101, 102), said bundles of elastic filaments (101, 102) being separate from each other, wherein each of said at least two bundles of elastic filaments (101, 102) and said plurality of inelastic elements (103), run along different and separate paths;

d. intermingling said bundles of elastic filaments (101, 102) and said inelastic elements (103);

e. collecting the composite yarn (100) obtained via said intermingling step.

17. The process according to claim 16, further comprising drafting said at least two bundles of elastic filaments and said and plurality of inelastic elements prior to said intermingling and wherein said providing a plurality of inelastic elements (103) includes initially drafting said plurality of inelastic elements, wherein said drafting is greater than said initially drafting.

18. The process according to claim 16, further comprising a step of texturizing the inelastic elements (103).

19. The process according to claim 16, wherein said intermingling comprises overfeeding said inelastic elements (103) to an intermingling device at a percentage between 1.2% and 7.0%.

20. A composite yarn (100) obtainable by means of a process according to claim 16.

21. A process for producing a composite yarn (100) comprising the steps of:

a. providing a plurality of inelastic elements (103), said inelastic elements (103) comprising a plurality of filaments and/or a bundle of coupled filaments;

b. providing at least two bundles of elastic filaments (101, 102) comprising a plurality of elastic filaments (150) connected together, said bundles of elastic filaments (101, 102) being separate from each other;

c. intermingling said bundles of elastic filaments (101, 102) and said inelastic elements (103); and d. collecting the composite yarn (100) obtained via said intermingling step, wherein the composite yarn (100) comprises at least 100 knots per meter when stretched with an elongation at 6.0% and wherein said inelastic elements are heat treated via a heating element before being connected to the elastic filaments.

* * * * *